US011011284B1

(12) United States Patent
Li

(10) Patent No.: US 11,011,284 B1
(45) Date of Patent: May 18, 2021

(54) DATA LINE CONVENIENT FOR STORAGE

(71) Applicant: SHENZHEN POPEYE INCUBATION INC LIMITED, Shenzhen (CN)

(72) Inventor: Hongxi Li, Shenzhen (CN)

(73) Assignee: SHENZHEN POPEYE INCUBATION INC LIMITED, Shenzhe (CN)

( * ) Notice: Subject to any disclaimer, the term of this patent is extended or adjusted under 35 U.S.C. 154(b) by 0 days.

(21) Appl. No.: 16/992,726

(22) Filed: Aug. 13, 2020

(30) Foreign Application Priority Data

Jul. 9, 2020 (CN) ..... 202021340779.9

(51) Int. Cl.
*H01B 7/04* (2006.01)
*H01F 7/02* (2006.01)

(52) U.S. Cl.
CPC ..... *H01B 7/04* (2013.01); *H01F 7/02* (2013.01)

(58) Field of Classification Search
CPC ..... H01B 7/04; H01F 7/02
USPC ..... 174/74 R
See application file for complete search history.

(56) References Cited

U.S. PATENT DOCUMENTS 5,710,812 A * 1/1998 Fogel ..... H04M 1/15 379/438
7,982,131 B2 * 7/2011 Fagrenius ..... H01B 7/06 174/111
8,841,556 B2 * 9/2014 Rothbaum ..... F16G 11/02 174/111
2007/0279072 A1 * 12/2007 Fagrenius ..... H01B 7/06 324/539
2009/0314515 A1 * 12/2009 Bevirt ..... H01B 7/40 174/110 R
2012/0121120 A1 * 5/2012 Gorzelany ..... H02G 3/04 381/384
2012/0279756 A1 * 11/2012 Rothbaum ..... F16G 11/02 174/135
2013/0048341 A1 * 2/2013 Walder ..... H04M 1/15 174/135
2014/0332264 A1 * 11/2014 Chen ..... H01B 7/40 174/70 R

* cited by examiner

*Primary Examiner* — Timothy J Thompson
*Assistant Examiner* — Michael F McAllister
(74) *Attorney, Agent, or Firm* — Law Offices Of Steven W. Weinrieb

(57) ABSTRACT

A data line convenient for storage includes a data line body (1); a plurality of magnetic rings (2) sleeve on the data line body (1); and a plurality of limit tube (3). Each limit tube (3) is arranged between each two adjacent magnetic rings (2). Two opposite ends of each limit tube (3) respectively abuts against the two adjacent magnetic rings (2). When the data line is coiled and stacked into a multiple-layer structure, the magnetic rings (2) located at two adjacent layers attract each other. The magnetic rings (2) at two adjacent layers can attract each other to fix the adjacent layers tightly for storage. The data line is simple in structure, each to use and properly designed to improve user experience.

20 Claims, 5 Drawing Sheets

DATA LINE CONVENIENT FOR STORAGE

FIELD OF THE INVENTION

The subject matter herein generally relates to electronic equipment, and particularly relates to a data line which is convenient for storage.

BACKGROUND OF THE INVENTION

With rapid development of mobile Internet technologies, mobile phones and other intelligent mobile devices have become indispensable for modern human beings. According to QuestMobile's report on China Mobile Internet in June 2018, China's mobile Internet users are more and more dependent on the Internet, and their average daily use of mobile phone is 289.7 minutes (nearly 5 hours). With long time and frequent use of intelligent mobile devices, the power consumption speed of intelligent mobile devices increases greatly, and people use data lines more and more frequently. However, when people use, store and carry the data line, it will always cause damage to the data line due to frequent winding and bending, and accelerate the aging of the data line. In order to better store and carry the data cable, some people attach Velcro on the data line to bind the wrapped data line; some use a data line storage box to store the data line; and some use a data line bracket to wrap the data line. However, these devices more or less require people to carry relevant auxiliary tools. If a user uses it improperly, it is more likely to damage the data line and bring trouble to people's lives. In order to solve the above problems, the present disclosure aims to provide a data line which is convenient for storage.

SUMMARY OF THE INVENTION

In order to overcome above mentioned technology problems, the present disclosure provides a data line which is convenient for storage, simple in structure, easy to use, and properly designed.

The present disclosure provides a data line convenient for storage. The data line convenient for storage includes a data line body (1); a plurality of magnetic rings (2) sleeve on the data line body (1); and a plurality of limit tube (3). Each limit tube (3) is arranged between each two adjacent magnetic rings (2). Two opposite ends of each limit tube (3) respectively abuts against the two adjacent magnetic rings (2). When the data line is coiled and stacked into a multiple-layer structure, the magnetic rings (2) located at two adjacent layers attract each other.

In at least one embodiment, the magnetic rings (2) are configured to rotate relative the data line body (1).

In at least one embodiment, a length of each limit tube (3) is same.

In at least one embodiment, a difference between an outer diameter of each limit tube (3) and an outer diameter of each magnetic rings (2).

In at least one embodiment, the limit tube (3) is a soft and flexible tube.

In at least one embodiment, the data line convenient for storage further includes an input plug (4) and an output plug (5) respectively connected with two opposite ends of the data line body (1).

In at least one embodiment, the input plug (4) is provided with a first limit portion (41) abutting against one of the magnetic rings (2).

In at least one embodiment, the output plug (5) is provided with a second limit portion (51) abutting against one of the magnetic rings (2).

The beneficial effect of the present disclosure is: through properly designed structure of the data line of the present disclosure, one end of the limit tube abuts against one of the magnetic rings, and the other end of the limit tube abuts against the other one of the magnetic rings, therefore, each limit tube limits a distance between two adjacent magnetic rings. When the data line body is stacked and coiled, the magnetic rings at adjacent layers cab limit a distance between two adjacent layers and attract each other, thus being convenient to fix adjacent layers and easy to store without additional tools. The data line of the present disclosure is properly designed, simple in structure, and easy to use, which greatly improves the user experience.

A data line convenient for storage, includes a data line body; and a plurality of magnetic rings sleeved on the data line body. When the data line convenient for storage is coiled and stacked into a multiple-layer structure, one of the plurality of magnetic rings is located at each layer of the multiple-layer structure, and the magnetic ring at each layer is aligned along a line which is substantially perpendicular to a plane where each layer is located and is capable of attract each other to fix all layers of the multiple-layer structure.

In at least one embodiment, wherein the magnetic rings are configured to rotate relative to the data line body.

In at least one embodiment, wherein the magnetic rings are configured to move relative to the data line body along a length direction of the data line body.

In at least one embodiment, wherein the magnetic rings cannot move relative to the data line body along a length direction of the data line body without extra force exerted thereon.

In at least one embodiment, there is friction between the magnetic rings and the data line body which prevent the magnetic rings from moving relative to the data line body along a length direction of the data line body without extra force exerted thereon.

In at least one embodiment, wherein an inner diameter of each magnetic ring is substantially equal to or slightly greater than an outer diameter of the data line body.

In at least one embodiment, the data line convenient for storage further includes an input plug (4) and an output plug (5) respectively connected with two opposite ends of the data line body (1).

In at least one embodiment, the input plug (4) is provided with a first limit portion (41) abutting against one of the magnetic rings (2).

In at least one embodiment, the output plug (5) is provided with a second limit portion (51) abutting against one of the magnetic rings (2).

In at least one embodiment, the magnetic rings are removably sleeved on the data line body.

In at least one embodiment, the magnetic rings are made of deformable material and configured to be switched from a deformed state in which the magnetic rings are deformed to be remove from the data line body and an original state in which the magnetic rings are sleeved on the data line body.

In at least one embodiment, each magnetic ring is composed of two magnetic portions with different poles.

When the data line convenient for storage is coiled and stacked into a multiple-layer structure, one of the plurality of magnetic rings is located at each layer of the multiple-layer structure, and the magnetic ring at each layer is aligned along a line which is substantially perpendicular to a plane where each layer is located and is capable of attract each other to fix all layers of the multiple-layer structure. Therefore, the data line can be fixed in the multiple-layer structure which is convenient for storage. The data line is simple structured and easy to use. Accordingly, user experience is improved.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE ILLUSTRATED EMBODIMENTS

Figure 1:
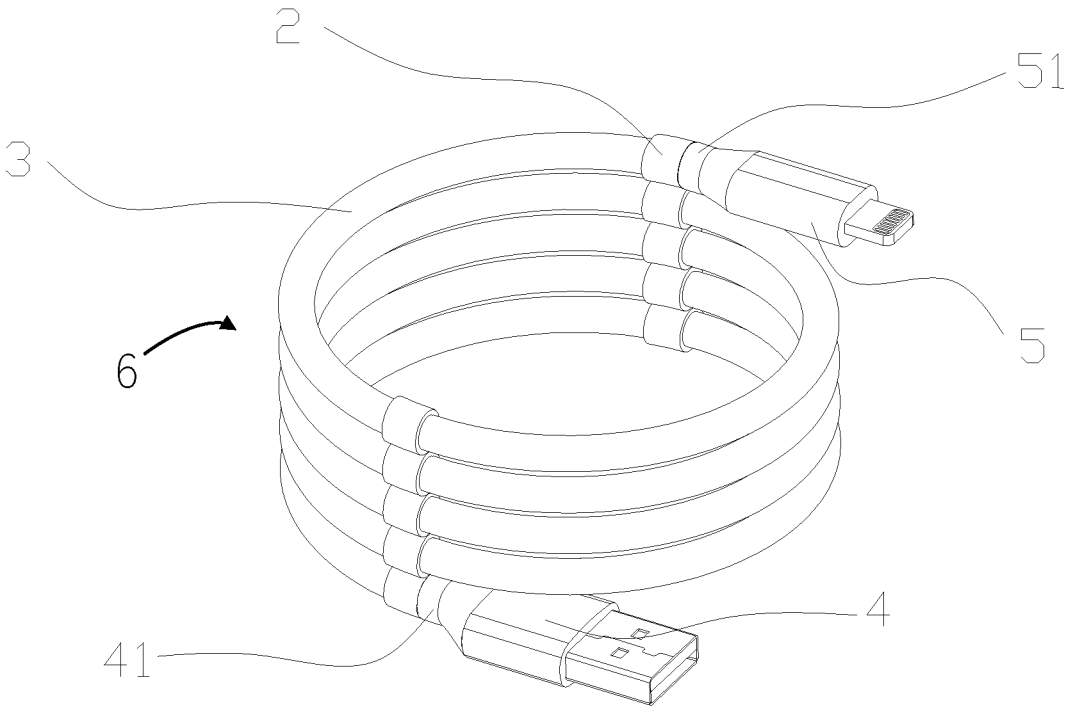
FIG. 1 is a schematic view of a data line in a first state according to a first embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the invention, "multiple" means two or more, unless otherwise specifically defined.

The terms "center", "length", "width", "top", "bottom", and other indicating directions or positions are based on the directions or positions shown in the attached drawings in order to facilitate the description of the embodiment and simplify the description of the invention, rather than indicating or implying that the device or element referred to must have a specific orientation, be constructed and operated in a specific orientation, it cannot be understood as a limitation of the embodiment of the invention.

Figure 2:
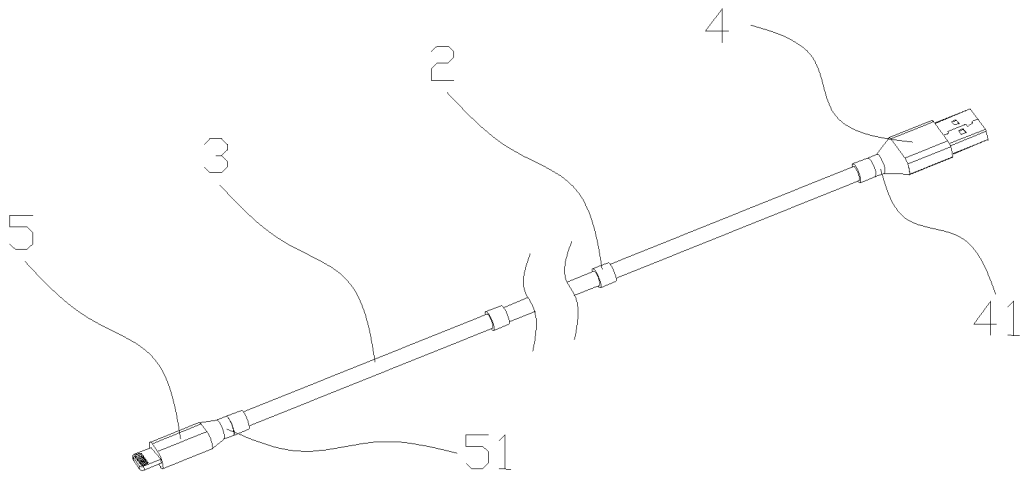
FIG. 2 is schematic view of the data line of FIG. 1 in a second state.
Figure 3:
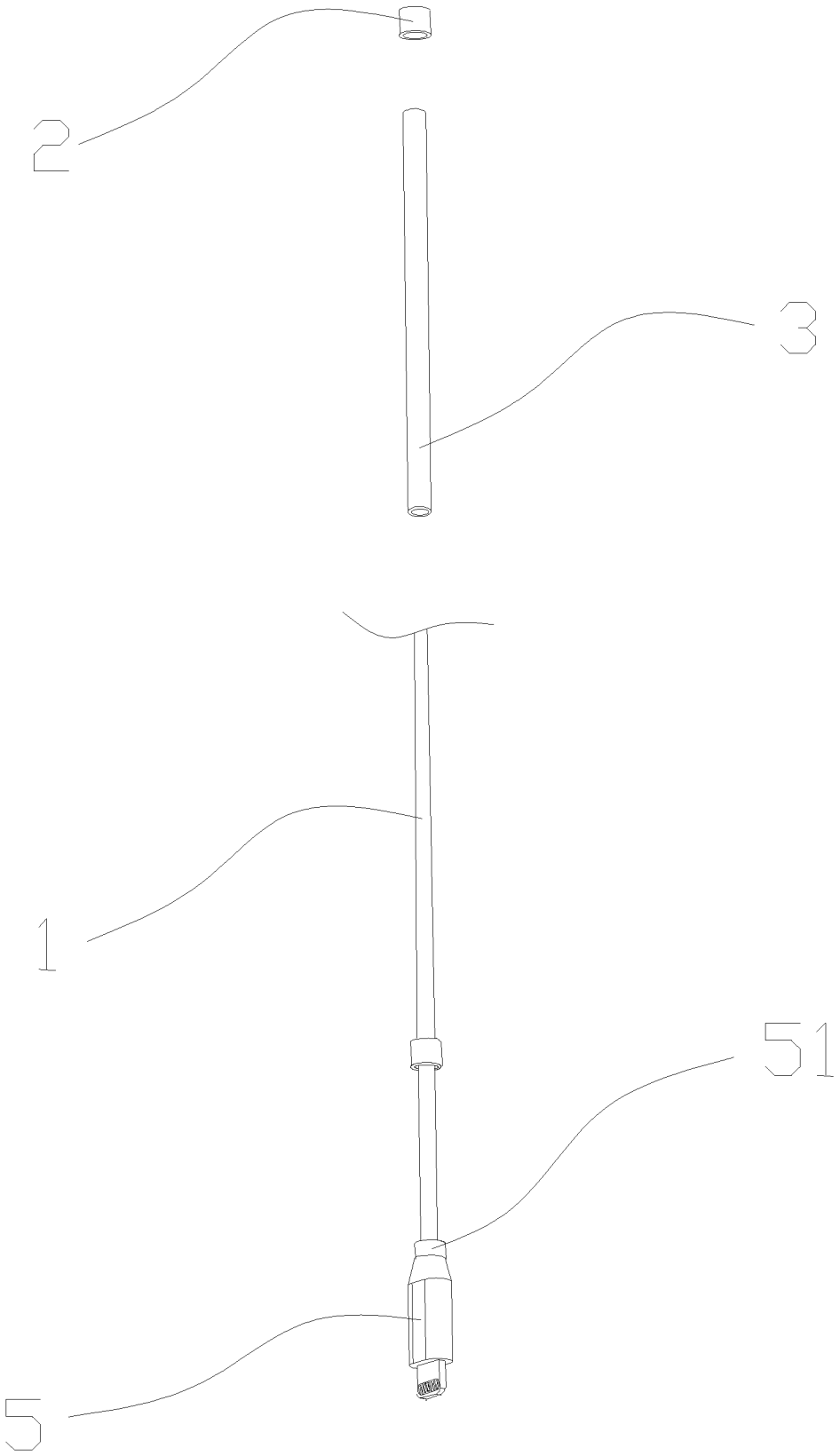
FIG. 3 is an exploded view of the data line of FIG. 1.

Referring to FIGS. 1-3, an embodiment of the present disclosure provides a data line. In at least one embodiment, the data line can include a data line body 1, a plurality of magnetic rings 2, and a plurality of limit tubes 3. The plurality of magnetic rings 2 and the plurality of limit tubes 3 are sleeve on the data line body 1. Each of the plurality of limit tubes 3 is arranged between two adjacent magnetic rings 2. One end of the limit tube 3 is arranged against one of the two adjacent magnetic rings 2, and the other end of the limit tube 3 is arranged against the other of the two adjacent magnetic rings 2. When the data line is coiled and stacked into multiple layers, magnetic rings 2 located in two adjacent layers attract each other, thus the multiple layers can be positioned and is convenient for storage.

The data line of the present disclosure, in which two opposite ends of the limit tube 3 are arranged against two adjacent magnetic rings 2. The limit tube 3 determines a distance between two adjacent magnetic rings 2. When the data line is coiled and stacked, the magnetic rings 2 located in two adjacent layers determines a distance between the two adjacent layers. The magnetic rings 2 located in two adjacent layers attract each other to fix the two adjacent layers together without additional tools. The coiled and stacked data line is convenient for storage. The data line is simple in structure, and easy to use which improve user experience greatly.

In at least one embodiment, the magnetic rings 2 is capable of rotating relative to the data line body 1. When the data line is coiled and stacked, the magnetic rings 2 located in two adjacent layers 2 approach to each other and rotate relative to the data line body 1 to facilitate poles of the magnetic rings 2 corresponding to each other. For example, a pole of the magnetic rings 2 in an upper layer is S, and a pole of the magnetic rings 2 in a lower layer is N, S attracts N so that the magnetic rings 2 located in the two adjacent layers can be fixed together. The magnetic rings 2 in different layers attracts together so that the data lines are coiled into a multiple-layer structure 6 which is convenient for storage. In at least one embodiment, there are at least two magnetic rings 2 located in each layer of the data line in the multiple-layer structure 6. If a user wants to put away the data line, he or she just needs to coil and stack the data line, the magnetic rings 2 located in adjacent layers attract each other automatically and the data line is easily changed into the multiple-layer structure 6. That is, it is easy to put away the data line without additional tools, therefore, capable of improving user experience greatly.

In at least one embodiment, a length of each of the plurality of limit tubes 3 is same. Therefore, distances between two adjacent magnetic rings are same. In such arrangement, when the data line is coiled and stacked, it is easy for the magnetic rings 2 in two adjacent layers to approach and attract each other. In such way, the data line can be easily put away and user experience is thus improved.

In at least one embodiment, a difference between an outer diameter of the limit tube 3 and an outer diameter of the magnetic rings 2 is less 2 mm. In such arrangement, the outer diameter of the limit tube 3 is substantially close to that of the magnetic rings 2, which facilitate positioning the magnetic rings 2 and is convenient for storage. When the data line is coiled into the multiple-layer structure 6, the magnetic rings in different layers are stacked in sequence and the limit tubes 3 are also stacked in sequence. The substantially same outer diameters facilitate fixing the layers tightly for storage when the data line is coiled into the multiple-layer structure 6.

In at least one embodiment, the limit tubes 3 are flexible. In at least one embodiment, the limit tubes 3 can be silicone tubes. The silicone tube has good elasticity and certain hardness. While effectively limiting the magnetic rings 2, the silicone tubes can also slightly deformed. When the data line body is coiled and stacked, the slightly deformed elastic silicone tubes can still ensure that the two adjacent magnetic rings 2 at two adjacent layers can attract each other when winding deviation occurs. It improves the use efficiency and improves user experience. The silicone tubes also have a strong excellent electric insulating performance. It hardly changes when being affected by moisture or water or temperature rise. Even if it changes into silicon dioxide under short-circuit combustion, it is still an insulator, which can provide effective protection for users when the data line body is damaged. The silicone tubes also have strong inertia, and does not react with substances in external environment, therefore capable of effectively isolate the data line body 1 from the external environment. In this way, the silicon tubes provide effective protection for the data line body and increasing the service life of the data line.

In at least one embodiment, the data line further includes an input plug 4 and an output plug 5. The input plug 4 is connected to one end of the data line body 1, and the output plug 5 is connected to the other end of the data line body 1. Through such arrangement, the data line body 1 can connect an input end and an output end of the electronic equipment through the input end plug 4 and the output end plug 5, so as to realize data or power transmission between electronic equipment. The structure is simple, and the design is reasonable.

In at least one embodiment, the input plug 4 is provided with a first limit portion 41, which abuts against the magnetic ring 2. Through such arrangement, the first limiting portion 41 is against one end of the magnetic ring 2, and the limiting tube 3 is against the other end of the magnetic ring 2, therefore, the magnetic ring 2 is positioned near the input plug 4. When the data line body is coiled and stacked, the magnetic rings 2 at different layers can attract each other to be positioned near the input plug 4. In such way, the data line is convenient for storage when being coiled in to the multiple-layer structure 6.

In at least one embodiment, the output plug 5 is provided with a second limit portion 51, which abuts against the magnetic ring 2. Through such arrangement, the second limiting portion 51 is against one end of the magnetic ring 2, and the limiting tube 3 is against the other end of the magnetic ring 2, therefore, the magnetic ring 2 is positioned near the output plug 4. When the data line body is coiled and stacked, the magnetic rings 2 at different layers can attract each other to be positioned near the output plug 4. In such way, the data line is convenient for storage when being coiled in to the multiple-layer structure 6.

In at least one embodiment, when the data line is coiled and stacked into a multiple-layer structure 6, one of the plurality of the magnetic rings 2 is located in each layer, and the plurality of the magnetic rings 2 is aligned along a line which is substantially perpendicular to a plane where each layer is located. Therefore, the plurality of the magnetic rings 2 can attract each other to fix all layers of the multiple-layer structure 6 together.

In at least one embodiment, the limit tube can be omitted. The magnetic rings can move relative to the data line body along a length direction of the data line body. When the data line is coiled and stacked, the plurality of magnetic rings 2 can be moved to be aligned along the along a line which is substantially perpendicular to a plane where each layer is located. Therefore, the plurality of the magnetic rings 2 can attract each other to fix all layers of the multiple-layer structure 6 together. Additionally, in at least one embodiment, an inner diameter of each magnetic ring 2 is substantially equal to or slightly greater than an outer diameter of the data line body 1, therefore, the magnetic rings 2 cannot move relative to the data line body without extra force exerted thereon. In alternative embodiments, there is friction between the magnetic rings 2 and the data line body 1, therefore, the magnetic rings 2 cannot move relative to the data line body without extra force exerted thereon.

In at least one embodiment, the magnetic rings are removably sleeved on the data line body. In such arrangement, the magnetic rings 2 can be adaptive to all kinds of data lines and can be used with all kinds of data lines.

Figure 4:
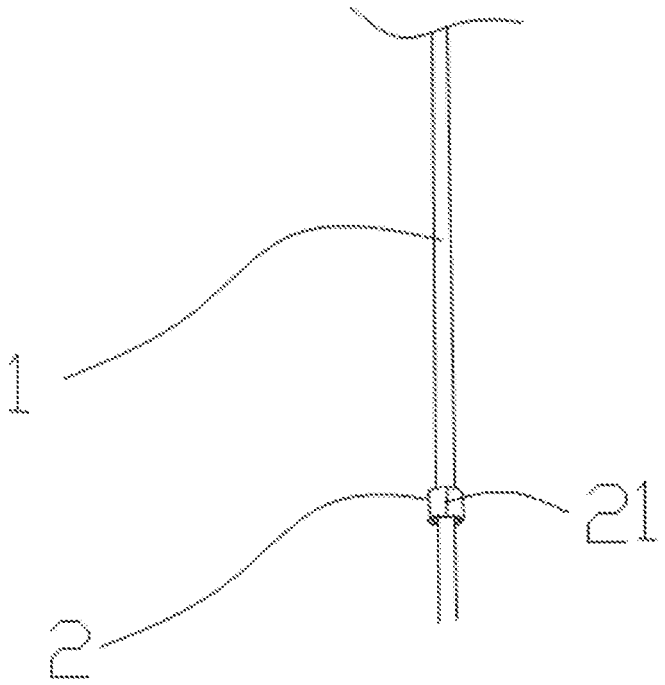
FIG. 4 is a schematic diagram of a data line according to a second embodiment of the present disclosure.

In at least one embodiment, the magnetic rings are made of deformable material and configured to be switched from a deformed state in which the magnetic rings are deformed to be remove from the data line body and an original state in which the magnetic rings are sleeved on the data line body. Referring to FIG. 4, each magnetic ring 2 is defined with an opening position 21 from which the magnetic ring 2 can be deformed to open so that the magnetic ring 2 can be removed from the data line body 1.

Figure 5:
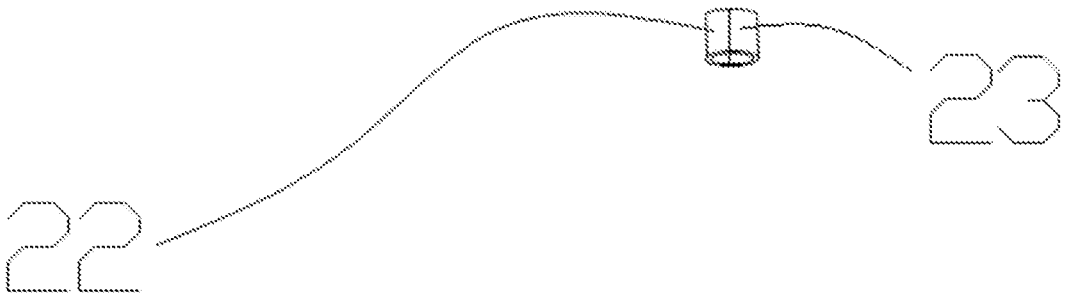
FIG. 5 is a schematic diagram of a magnetic ring according to an embodiment of the present disclosure.

In at least one embodiment, each magnetic ring is composed of two magnetic portions 22 and 23 with different poles (referring to FIG. 5). Therefore, the two magnetic portions 22 and 23 can attract each other to form the magnetic ring 2 which can be sleeved on the data line body 1.

It is to be understood, even though information and advantages of the present exemplary embodiments have been set forth in the foregoing description, together with details of the structures and functions of the present exemplary embodiments, the disclosure is illustrative only. Changes may be made in detail, especially in matters of shape, size, and arrangement of parts within the principles of the present exemplary embodiments to the full extent indicated by the plain meaning of the terms in which the appended claims are expressed.

What is claimed is:

1. A data line to be disposed within a coiled multi-layer data line body structure which will facilitate compact storage of said data line, comprising:

a data line body;

a plurality of limit tubes sleeved upon said data line body and having predetermined length dimensions and diametrical extents; and a plurality of magnetic rings also sleeved upon said data line body so as to be interposed between adjacent ones of said plurality of limit tubes wherein a first end of each one of said plurality of limit tubes abuts against a first end of a first one said plurality of magnetic rings while a second opposite end of each one of said plurality of limit tubes abuts against a first end of a second one of said plurality of magnetic rings, whereby when said data line body is coiled and stacked into a coiled multi-layer data line body structure, said magnetic rings, (2) disposed upon adjacent layers of said coiled multi-layer data line body structure and aligned with each other along a line which is substantially perpendicular to a plane within which each layer of said coiled multi-layer data line body structure is disposed, will be attracted to each other so as to preserve said coiled multi-layer data line body structure as a coiled multi-layer data line body structure.

2. The data line convenient for storage according to claim 1, wherein said plurality of magnetic rings are configured to rotate relative to said data line body.

3. The data line convenient for storage according to claim 1, wherein said predetermined length dimensions of each one of said plurality of limit tubes is the same.

4. The data line convenient for storage according to claim 1, wherein:

each one of said plurality of magnetic rings has a diametrical extent which is greater than said diametrical extent of each one of said plurality of limit tubes.

5. The data line convenient for storage according to claim 1, wherein each one of said plurality of limit tubes is fabricated from a soft and flexible material.

6. The data line convenient for storage according to claim 1, further comprising an input plug and an output plug respectively connected to opposite ends of said data line body.

7. The data line convenient for storage according to claim 6, wherein said input plug is provided with a first limit portion abutting against one of said plurality of magnetic rings.

8. The data line convenient for storage according to claim 6, wherein said output plug is provided with a second limit portion abutting against one of said plurality of magnetic rings.

9. A data line convenient for storage, comprising:

a data line body having a predetermined length; and a plurality of magnetic rings sleeved upon said data line body, wherein when said data line body of said data line convenient for storage is coiled and stacked into a coiled multi-layer data line body structure, said magnetic rings, disposed upon adjacent layers of said coiled multi-layer data line body structure and aligned with each other along a line which is substantially perpendicular to a plane within which each layer of said coiled multi-layer data line body structure is disposed, is attracted to each other so as to retain all layers of said coiled multi-layer data line body structure fixedly secured with respect to each other so as to preserve said coiled multi-layer data line body structure as a coiled multi-layer data line body structure.

10. The data line convenient for storage according to claim 9, wherein said plurality of magnetic rings are configured to rotate relative to said data line body.

11. The data line convenient for storage according to claim 9, wherein said plurality of magnetic rings are configured to move relative to said data line body along said predetermined length dimension of said data line body.

12. The data line convenient for storage according to claim 11, wherein said plurality of magnetic rings cannot move relative to said data line body along said predetermined length of said data line body without extra force exerted thereon.

13. The data line convenient for storage according to claim 12, wherein there is friction between said plurality of magnetic rings and said data line body which prevents said plurality of magnetic rings from moving relative to said data line body along said predetermined length of said data line body without extra force exerted thereon.

14. The data line convenient for storage according to claim 12, wherein an inner diameter of each one of said plurality of magnetic rings is substantially equal to or slightly greater than an outer diameter of said data line body.

15. The data line convenient for storage according to claim 9, further comprising an input plug and an output plug respectively connected to opposite ends of said data line body.

16. The data line convenient for storage according to claim 15, wherein the input plug is provided with a first limit portion abutting against one of said plurality of magnetic rings.

17. The data line convenient for storage according to claim 15, wherein the output plug is provided with a second limit portion abutting against one of said plurality of magnetic rings.

18. The data line convenient for storage according to claim 9, wherein said plurality of magnetic rings are removably sleeved upon said data line body.

19. The data line convenient for storage according to claim 18, wherein said plurality of magnetic rings are made from a deformable material and configured to be switched from a deformed state in which said plurality of magnetic rings are deformed so as to be removed from said data line body and an original state in which plurality of magnetic rings are sleeved upon said data line body.

20. The data line convenient for storage according to claim 18, wherein each one of said plurality of magnetic rings is composed of two magnetic portions with different poles.

* * * * *